US005813947A

United States Patent [19]

Densmore

[11] Patent Number: 5,813,947

[45] Date of Patent: Sep. 29, 1998

[54] EXERCISE DESK

[76] Inventor: Elnore A. Densmore, 111 Tower Pl., Seattle, Wash. 98109-3250

[21] Appl. No.: 748,474

[22] Filed: Nov. 8, 1996

[51] Int. Cl.[6] ..... A63B 22/02

[52] U.S. Cl. ..... 482/51; 482/54; 482/52

[58] Field of Search ..... 482/51, 54, 52, 482/70, 71, 72, 57

[56] References Cited

U.S. PATENT DOCUMENTS

| | | | |
|---|---|---|---|
| 1,919,627 | 7/1933 | Fitz Gerald . | |
| 3,738,649 | 6/1973 | Miller . | |
| 3,874,657 | 4/1975 | Niebojewski . | |
| 3,968,963 | 7/1976 | Sileo . | |
| 4,300,761 | 11/1981 | Howard . | |
| 4,676,501 | 6/1987 | Hoagland et al. | 482/52 |
| 4,679,787 | 7/1987 | Guilbault . | |
| 4,743,008 | 5/1988 | Fermaglich et al. . | |
| 4,865,313 | 9/1989 | Kuo . | |
| 4,913,423 | 4/1990 | Farran et al. . | |
| 5,470,298 | 11/1995 | Curtis . | |
| 5,669,857 | 9/1997 | Watterson et al. | 482/54 |

FOREIGN PATENT DOCUMENTS 828005 10/1990 France .

*Primary Examiner*—Lynne A. Reichard
*Attorney, Agent, or Firm*—Ronald M. Anderson

[57] ABSTRACT

An exercise desk enables a user to exercise on an exercise device while carrying out unrelated activities, such as working, by providing a work surface for supporting articles used in such activities. The exercise desk serves as an enclosure for storing the exercise device out of sight when it is not in use and has the look and finish of fine furniture. Additionally, the exercise desk can serve as an upright desk when the user is not exercising. Another embodiment of the exercise desk is usable as a low table or bench when the exercise device is not in use. A top of the exercise desk can be locked in the closed position to prevent opening desk doors that provide access to the interior, and thus preclude unauthorized use of the exercise device stored within.

35 Claims, 6 Drawing Sheets

Fig. 1
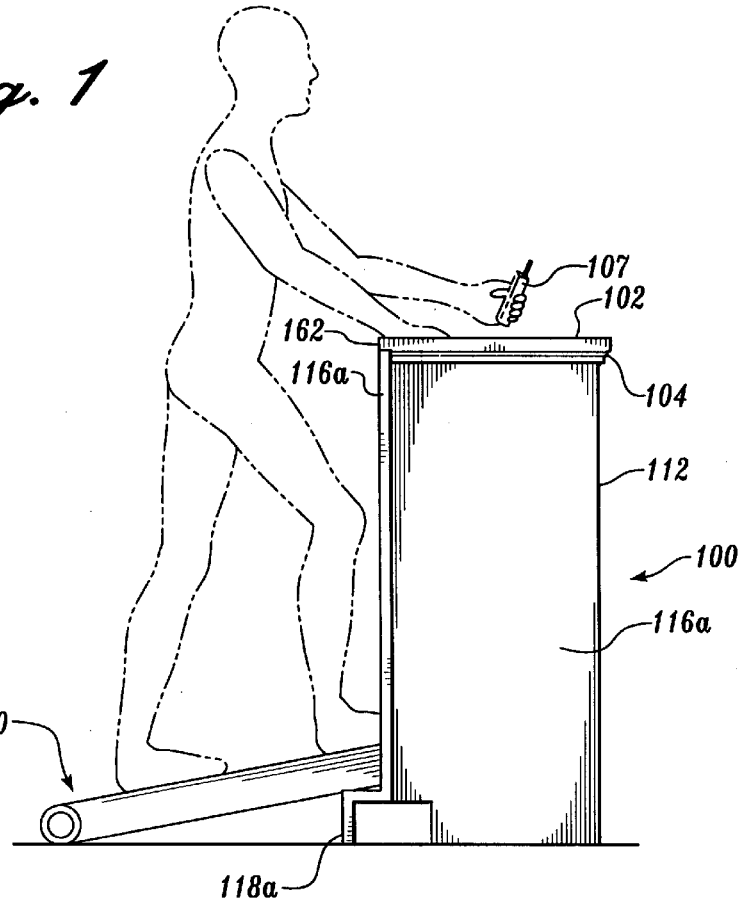
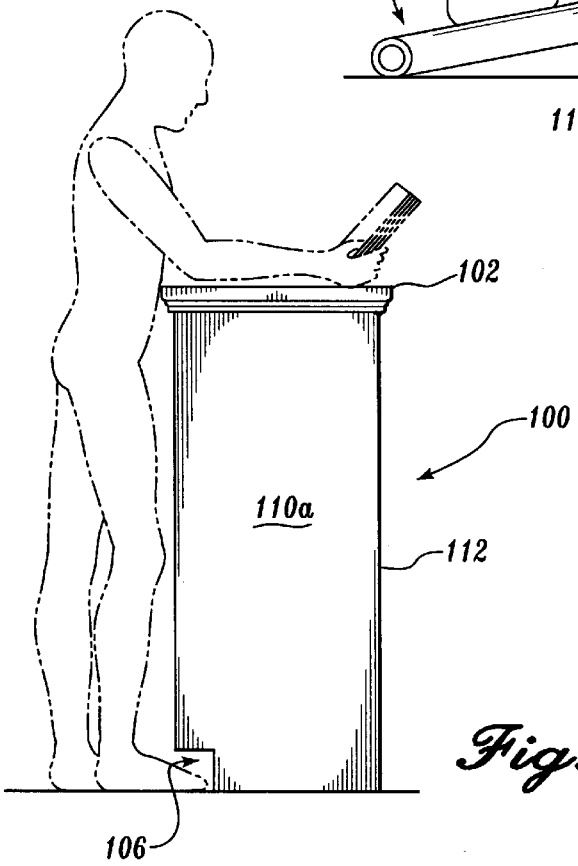
Fig. 2

EXERCISE DESK

FIELD OF THE INVENTION

The present invention generally relates to exercise equipment, and more specifically, to exercise equipment combined with a storage cabinet that also functions as an article of furniture.

BACKGROUND OF THE INVENTION

The benefits of regular exercise for improving both mental and physical health are well understood. While any regular exercise program can be beneficial, it is particularly important to engage in a cardiovascular exercise that elevates the heart rate and exercises the major muscle groups. To provide the desired benefits, an individual should exercise for at least thirty minutes at a time, three to four times per week. Unfortunately, although most people understand the need to exercise to maintain a healthy body, in today's busy world, they find it very difficult to devote even that short amount of time to exercising.

While a thirty minute exercise session seems relatively short, in fact much more time is typically required. Additional time is often needed to drive to a gym, change into attire suitable for exercise, to cool down and shower afterwards, and then change back into business or other attire. It is therefore not surprising that many people prefer to exercise at home, using their own equipment. Treadmills, stair-step machines, stationary bicycles, and cross-country ski machines can be purchased for use at home to achieve a good cardiovascular workout. However, even though having such exercise equipment at home makes it more convenient to begin exercising and requires less total time, there are drawbacks. For example, when not in use, most home exercise equipment remains exposed to visiting guests, and its appearance typically does not fit with conventional room decor. In short, because exercise equipment is usually black and often includes mechanical devices such as pulleys, springs, or weights, such equipment is generally an eyesore when left exposed in a home setting. Even if the exercise equipment folds into a smaller configuration, it must still typically be stored in a closet or unused space so that it is out of sight. The time required to move the equipment from storage to where it will be used increases the total time required for exercising and tends to provide an excuse not to do so.

Furthermore, even when exercise equipment is left exposed within the home and available for use at anytime, people are often too busy with their work or professional activities to allocate time to exercise. What is needed is exercise equipment that can be used while doing other productive things. By combining work time with exercise time, a person will more likely be able to obtain the healthful benefits of using exercise equipment without adversely impacting their busy schedule for work and other activities. Certain types of exercise are done while in a standing position or while sitting, e.g., walking on a treadmill and pedaling a stationary bicycle. Clearly, a person engaged in such physical activity can readily use a telephone, notepad and pencil, or even a notebook computer. However, conventional exercise equipment, such as treadmills, do not provide a surface that facilitates working while exercising. Generally, the only accessory occasionally available on exercise equipment to assist in such endeavors is a book stand. Many people simply watch television as a diversion while exercising, because without a work surface to support implements used in business, engaging in work-related activity while exercising is too difficult.

Another problem with maintaining a regular exercise program arises due to interruptions in an exercise schedule caused by traveling. While some hotels and motels provide exercise facilities, the same time constraint problems noted above limit the options for using the equipment in such a facility. Ideally, exercise equipment should be available in each guest room of a hotel or motel, so that it can be used while the person is conducting business and without the delay incurred in dressing for exercise, finding the exercise facility, and then returning to the room. However, since many people would object to having conventional exercise equipment exposed to view in a hotel or motel room, hotel and motel owners are not likely to be interested in providing it, even if additional fees could be charged for its use. What is needed is exercise equipment that not only includes a work surface for use while exercising, but also is combined with a cabinet of furniture quality for storing the equipment when not in use. The combination of a work surface and a quality storage cabinet with exercise equipment would thus provide substantial benefits for both commercial applications in the hotel/motel industry and in residential applications.

SUMMARY OF THE INVENTION

In accordance with the present invention, an exercise desk that enables a person to exercise while carrying on another activity unrelated to exercising is defined. The exercise desk includes an exercise device having at least one force resisting movable part coupled to it. When exercising in an upright position, a person applies force to the movable part to obtain the benefit of exercising. The exercise device is selectively configured in two different states. In the first state, the exercise device is unusable for exercising, while in the second state, it is usable for that purpose. Also included is an enclosure having an opening on at least one side for receiving and storing the exercise device in the first state. This enclosure is disposed adjacent to the exercise device when the exercise device is in the second state in which it is usable for exercising. A work surface comprises one side of the enclosure that is oriented so as to define an upper surface of the enclosure when the exercise device is in the second state. The enclosure is sized so that the upper surface is at a height appropriate to support an article used by the person when engaged in the other activity while exercising in the upright position, and the upper surface thus serves as a work surface.

In one preferred form of the invention, the exercise device is pivotally attached to the enclosure and is pivoted between the first state and the second state about a pivot axis. It is contemplated that the exercise device may be either a treadmill, a stair-step machine, a cross-country ski machine, or a stationary bicycle. It should be noted that each of these types of exercise devices permit the user to remain in an upright position while exercising on the device.

The enclosure includes a moveable cover that is positionable over the open side of the enclosure to at least partially close that side, when the exercise device is stored in the first state. Further, in the preferred form of the invention, the enclosure has a generally rectilinear, elongate shape.

While not required when storing some types of exercise devices, in at least one preferred embodiment of the invention, the work surface is pivotally attached to the enclosure about a pivot axis and is movable about the pivot axis to enable the exercise device to be moved in and out of its stored position within the enclosure. For one embodiment, the enclosure is adapted to be tilted from an upright position when the exercise device is in use, to a horizontal position wherein the enclosure substantially covers and encloses the exercise device for storage. The enclosure serves as a table when in this horizontal position. It should also be noted that when in the upright position, the enclosure provides support for the person who is exercising on the exercise device.

Because the enclosure is designed to appear as furniture and to generally hide the exercise device when the device is not in use, the exercise desk can be placed in offices, hotel/motel rooms, or in the home without concern for the appearance of the exercise device, which is intended to be stored within the enclosure when not being used to exercise. In addition, the enclosure greatly facilitates use of the exercise device by those who must continue with a busy work schedule, since the work surface can be used to support a telephone, a portable computer, notepad and paper, or other such implements.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein:

FIG. 1 is a side view of an exercise desk in the open position, so that a user can enjoy the benefits of exercising on a treadmill device, while using the top of the desk for a work surface;

FIG. 2 is a side view of the exercise desk in the closed position, so that the user can employ the top of the exercise desk as a work surface;

Figure 17:
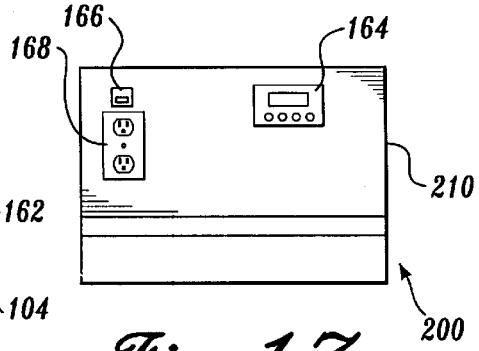

FIG. 17 is a top view of the first embodiment of the exercise desk's top that illustrates an electronic instrument for measuring exercise activity, a data outlet, and an electrical outlet; and FIGS. 18A–18D respectively show a top plan view, a rear elevational view (both doors closed), a top plan view (both top panels open), and a rear elevation view showing the left door and top panel open, for another embodiment of the present invention.

DESCRIPTION OF THE PREFERRED EMBODIMENT

In FIG. 1, a first embodiment of an exercise desk 100 that provides a working surface for a user and serves as a functional piece of furniture is illustrated. In this view, the user is shown exercising on a treadmill 300, while employing a top 102 of the exercise desk as a working surface to support a cell phone 107 (and/or other business related articles, or at least articles unrelated to exercising). Since top 102 is generally horizontal, both when the treadmill is in use and when the treadmill is stored inside the exercise desk, it provides a convenient work surface for supporting a note pad, computer, writing implements, reference materials, and almost any other relatively small objects that might be used when working at a conventional desk at which a user is normally seated. In addition, top 102 and the exercise desk in general, provide a support for the user while exercising, enabling the user to rest his/her forearms on the top or grasp its edges in lieu of vertical frame member hand support sometimes provided on treadmills.

In FIG. 2, exercise desk 100 is shown after treadmill 300 is folded upwardly and stored inside the exercise desk, so that the treadmill is completely hidden from view. Once the treadmill is stored out of sight in this manner, exercise desk 100 is usable as a stand-up desk, and because of its furniture-like appearance, is readily adapted to fit the decor of almost any living space. The user's ability to use top 102 as a work surface is enhanced by providing a kick space 106 for the user's feet when the user is standing at the exercise desk.

Figure 3:
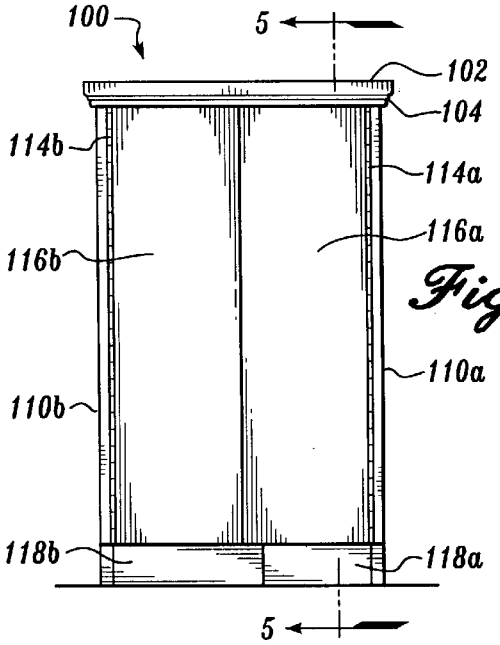
FIG. 3 is a front view of the exercise desk.
Figure 4:
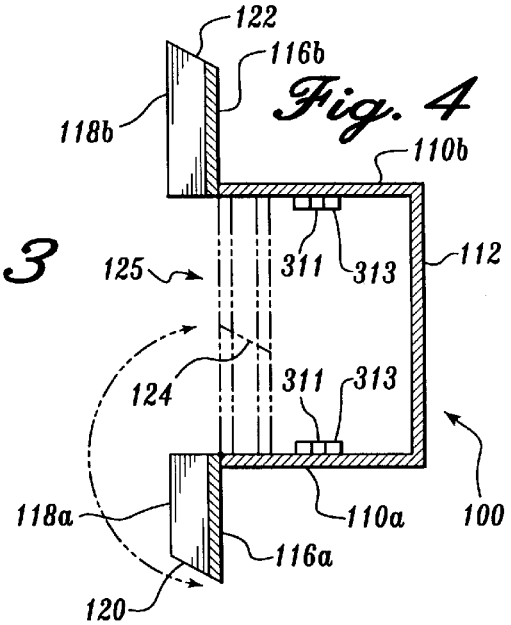
FIG. 4 is a top cross-sectional view of the exercise desk, with doors on one side of the exercise desk shown in their fully open positions.

Further details of exercise desk 100 are illustrated in FIGS. 3–7B. In FIG. 3, a front view of exercise desk 100 shows that the rear edge of top 102 includes a lip 104 that overhangs doors 116*a* and 116*b* when they are closed to store the exercise equipment inside the interior of the exercise desk. Lip 104 preferably includes a decorative molding, e.g., a Roman ogee profile, on its outer surface, which adds to and enhances a furniture-like look of the exercise desk. Desk door 116*a* is connected by a hinge 114*a* to a side wall 110*a* of the exercise desk, and similarly, desk door 116*b* is connected by a hinge 114*b* to a side wall 110*b* disposed at the opposite side of the exercise desk. Further, a kick panel 118*a* and a kick panel 118*b* are respectively attached to the lower edge of desk doors 116*a* and 116*b* to define kick space 106. An angled end 120 on kick panel 118*a* engages a matching angled end 122 on kick panel 118*b* to prevent desk door 116*b* from opening until desk door 116*a* opens, as indicated by phantom line 124 in FIG. 4. In the view of FIG. 4, desk doors 116*a* and 116*b* are illustrated with the desk doors in their fully open positions, i.e., after the desk doors have been pivoted approximately 180° about their respective hinges, from their closed positions, which are shown in relief, as generally indicated by a reference numeral 125. The overlapping relationship of angled ends 120 and 122 is employed to assist in locking the desk doors in their closed positions using a single locking mechanism, as explained below.

Figure 5:
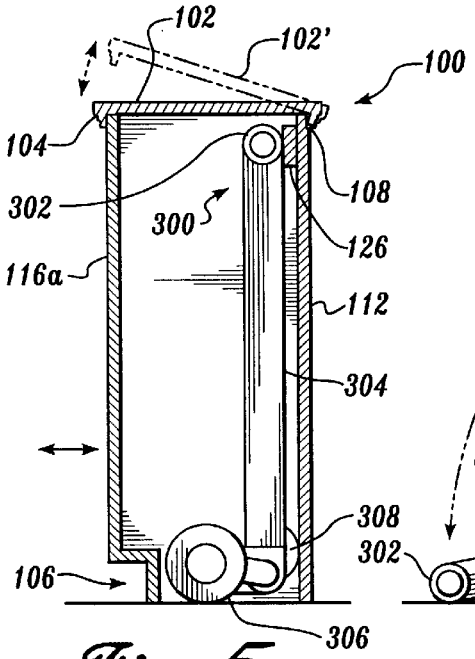
FIG. 5 is a side cross-sectional view of the exercise desk in the closed position with the treadmill stored within the desk, and with a phantom view of the top of the exercise desk pivoting open to facilitate deployment of a treadmill stored within the exercise desk interior.

FIG. 5 shows treadmill 300 in its stored position within the interior of exercise desk 100. Since lip 104 on top 102 overhangs the top outer surface of desk doors 116*a* and 116*b*, the desk doors cannot be opened until the top of the exercise desk is pivoted upwardly about a hinge 108 that extends along the inside top edge of a front 112. Further, this Figure shows the top of the exercise desk in relief after it is pivoted about hinge 108 to a disengaged position (102'), so that the user can open desk doors 116*a* and 116*b*, and pivotally rotate treadmill 300 from its stored position to the position in which it can be used for exercising. A stop or block 126 is mounted on the inside surface of front 112 for supporting an end 302 of treadmill 300 while it is being stored.

Figure 6:
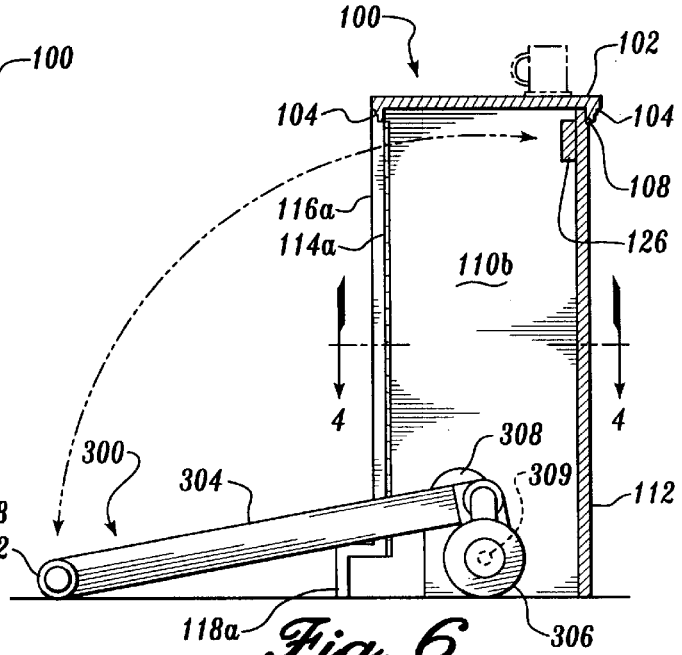
FIG. 6 is a side cross-sectional view of the exercise desk in the open position with the treadmill positioned for exercising by the user.

Moving now to FIG. 6, treadmill 300 is shown after it is pivoted outwardly from the interior of exercise desk 100. A treadmill belt 304 rotates about wheels 306, which serve as a pivot, driving a flywheel 308, which helps to ensure that the treadmill belt moves at a more uniform rate. It is also contemplated that exercise equipment not having wheels 306 may be pivotally mounted inside exercise desk 100 using a hinge (not shown) or other suitable pivotal connection, such as pivot pins 309 (only one of which is shown in FIG. 6). These pins drop into slots 311 formed in blocks 313, which are attached on the inner surfaces of the sides of the exercise desk.

When treadmill 300 is deployed for use in exercising, desk doors 116*a* and 116*b* are swung outwardly to their fully open position about hinges 114*a* and 114*b*. Although not shown, it is also contemplated that instead of being attached by the hinges to the exercise desk, desk doors 116*a* and 116*b* may instead be fitted in slots (not shown) along the inside surfaces of sides 110*a* and 110*b*, respectively, when closed. When opened, the user can then store the desk doors outboard of sides 110*a* and 110*b*, by sliding the doors into slots formed between the outer surface of the sides and lip 104, which would be extended around the sides of the top. However, this alternative arrangement for securing the doors and storing them during use of the treadmill or other exercise device is less efficient and therefore less preferable.

Sometimes, the user may wish to secure exercise desk 100 in the closed position, preventing unauthorized use of the exercising equipment stored inside. For example, if the exercise desk is disposed in a hotel/motel room and is made available, for an additional cost, to a person renting the room, it would be desirable to lock the doors in their closed positions until opened to use the exercise equipment stored therein by a tenant who has paid the extra fee and been provided a key to open the desk doors. Also, if children in a home might inadvertently open the desk doors, allowing the exercise equipment stored in exercise desk 100 to pivot outwardly unexpectedly, injury is possible. In either case, it would be desirable to lock the desk doors in their closed position, preventing access to the treadmill or other exercise equipment by someone who does not have a key. One way of accomplishing this goal is to couple top 102 to desk doors 116*a* and/or 116*b* with a locking mechanism.

Figure 7A:
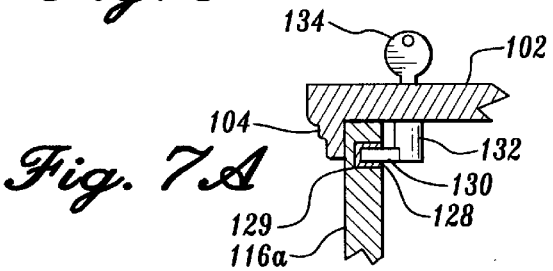
FIG. 7A is a side cross-sectional view of a mechanism for locking the top surface of the exercise desk to prevent the doors from being opened, shown with the mechanism in a locked position.
Figure 7B:
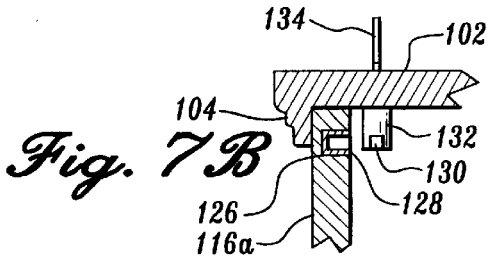
FIG. 7B is a side cross-sectional view of the mechanism for locking the top surface of the exercise desk, shown in an unlocked position.

In FIG. 7A, top 102 is securely fastened to desk door 116*a* by a lock 132. Lock 132 is a generally conventional cylinder type having a tang 130 that is rotated into engagement with a slot 128 disposed on an inner surface of desk door 116*a*, near its top edge. Slot 128 is reinforced with a metal insert 126. In FIG. 7B, tang 130 has been rotated out of slot 128 by turning a key 134 after the key is inserted into lock 132, so that the locking mechanism is in the disengaged/unlocked position. When tang 130 engages slot 128 in desk door 116*a*, top 102 can not be pivoted upwardly, and lip 104 prevents desk doors 116*a* and 116*b* from being opened. Moreover, the overlapping relationship of angled ends 120 and 122 on kick panels 118*a* and 118*b* preclude desk door 116*b* from being opened until desk door 116*a* is opened. Thus, until key 134 is rotated to turn tang 130 out of engagement with slot 128, the exercise equipment, such as treadmill 300, which is stored within the interior of exercise desk 100, is not accessible.

Figure 8:
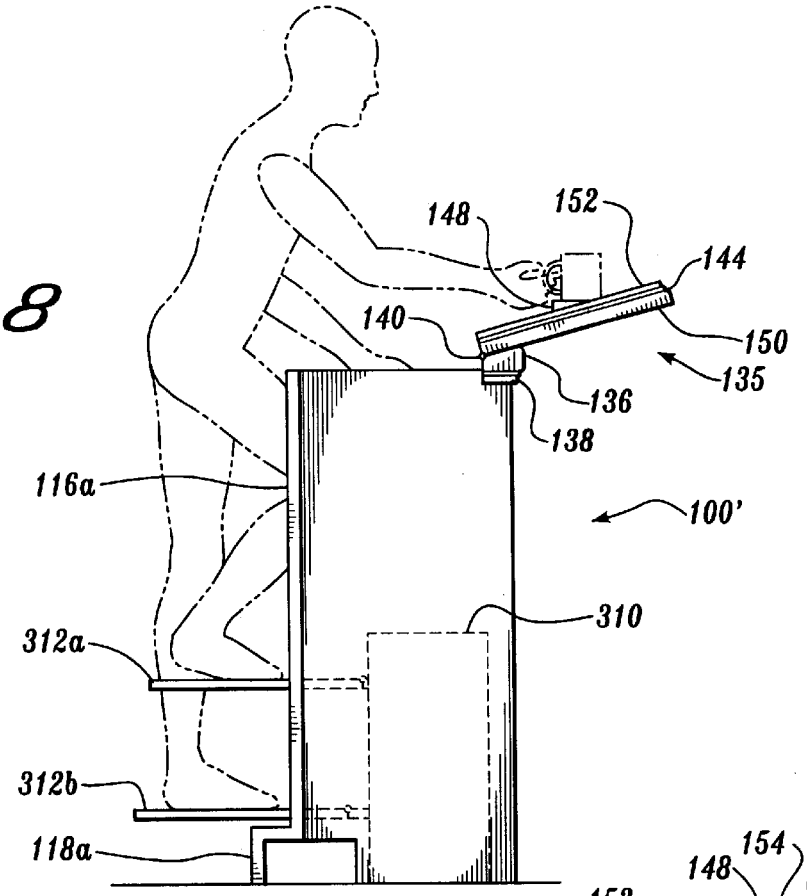
FIG. 8 is a side view of a second embodiment of the exercise desk, with the desk doors in the open position, and the user employing a stair-step device for exercise.

A second embodiment of the present invention, an exercise desk 100', is illustrated in FIG. 8. In this embodiment, a top 135 of desk 100' is bifurcated into a pivoting top 144 and a stationary top 136, which are coupled to each other by a hinge 140. Further, pivoting top 144 is shown after it is rotated about hinge 140 to a fully open position, so that a bottom surface 152 of the pivoting top is exposed for use as a working surface. In this illustrated preferred embodiment, pivoting top 144 is fully open when bottom surface is angled at about twenty degrees from the horizontal, but it is further contemplated that pivoting top 144 can alternatively open through an angle of approximately 180° to provide a horizontal working surface. Since bottom surface is angled relative to the horizontal in the embodiment of FIG. 8, a platform 148 is attached to bottom surface 152 to provide for a substantially horizontal surface that can accommodate beverage containers and/or office equipment that is preferably supported on a horizontal surface.

In exercise desk 100', the exercise device comprises a stair-step machine 310. The stair-step machine includes step levers 312*a* and 312*b*, on which the user steps to apply a downward force in an alternating repetitive manner. While exercising in this manner, the user can grasp the top of sides 110*a* and/or 110*b* for support, but can continue working using business apparatus supported on the work surface provided by bottom surface 152. Thus, the user enjoys the benefits of a convenient work surface to facilitate carrying on other activities (e.g., work related) while exercising.

Figure 9:
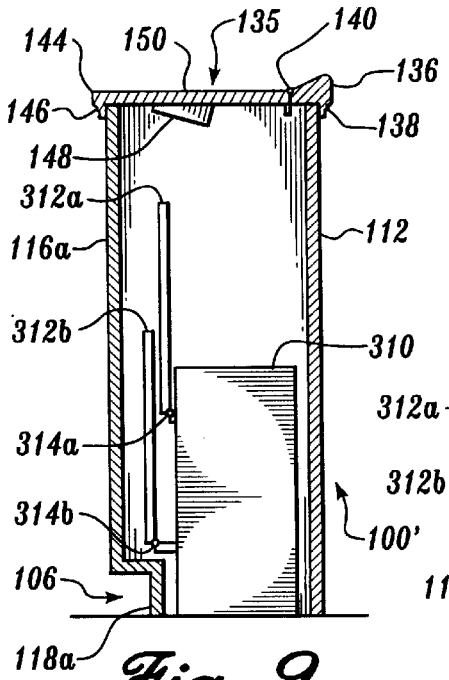
FIG. 9 is a side cross-sectional view of the second embodiment of the exercise desk, with the desk doors in the closed position, and the stair-step device folded and stored therein.

Referring now to FIG. 9, a side sectional view of desk 100' shows top 135 in the closed position. Stair-step machine 310 is shown stored inside desk 100', with step levers 312*a* and 312*b* rotated to a substantially vertical position, respectively, about a hinge 314*a* and a hinge 314*b*. When top 135 is closed, exercise desk 100' can be employed as a decorative piece of furniture and serve as a stand-up desk having a top surface 150 that is usable as a working surface when standing behind the exercise desk. A lip 146 extends downwardly along the periphery of pivoting top 144 and a similar lip 138 extends on around the periphery of stationary top 136. These lips comprise a decorative molding, for example, with a Roman ogee profile. Desk doors 116*a* and 116*b* are held closed by lip 146, which engages the outer surface of the desk doors, along their top edge.

Figure 10:
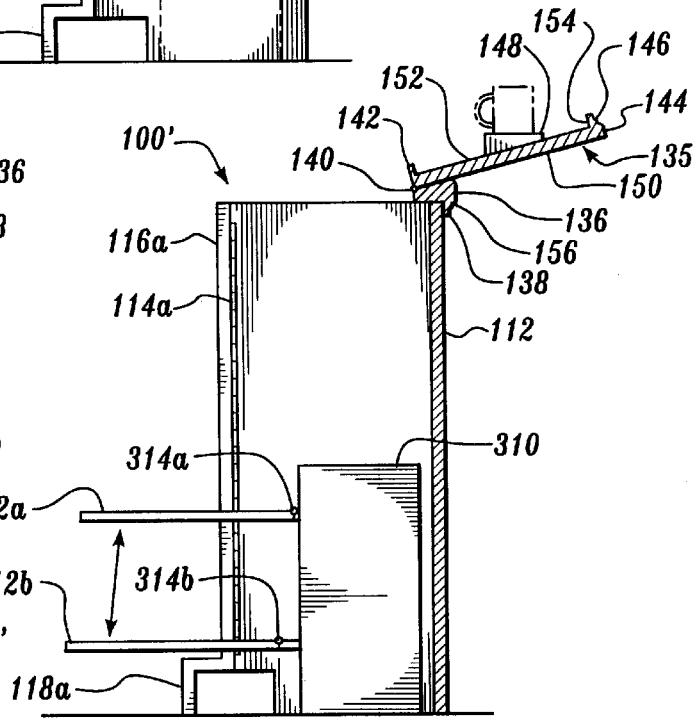
FIG. 10 is a side cross-sectional view of the second embodiment of the exercise desk in the open position, with the stair-step device deployed so that the user can employ the stair-step device for exercising.

Referring now to FIG. 10, a side cross-sectional view of exercise desk 100' is illustrated, showing top 135 in the open position. In this view, stair-step machine 310 is operational, with step lever 312*a* and step lever 312*b* being oriented substantially horizontal. Pivoting top 144 is shown in its open position. A ridge 142 that extends across the width of the bottom surface of pivoting top 144 is provided to keep objects placed on bottom surface 152 from sliding off its inclined plane.

Figure 11:
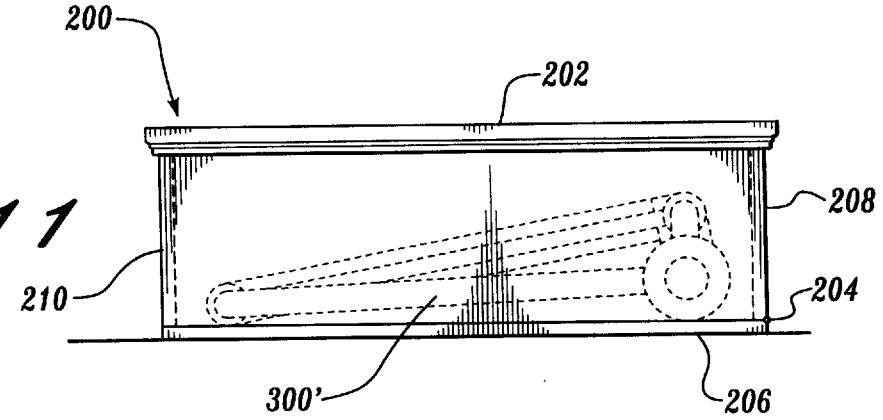
FIG. 11 is a side view of a third embodiment of the exercise desk in the closed position, in which the desk is usable as a low table, and a treadmill is stored inside the exercise desk.

In FIG. 11, a side view of a third embodiment of an exercise desk 200 is illustrated in the closed position, in which a treadmill 300' is hidden within the interior of the exercise desk. Desk 200 includes a top 202, a bottom 206, a hinge 204, and ends 208 and 210. In the closed position, desk 200 can be employed as a low table of the type commonly referred to as a "coffee table," or as a bench, perhaps with a padded cushion being provided for more comfortable seating, and any one of a variety of different types of exercise devices can be stored inside.

Figure 12:
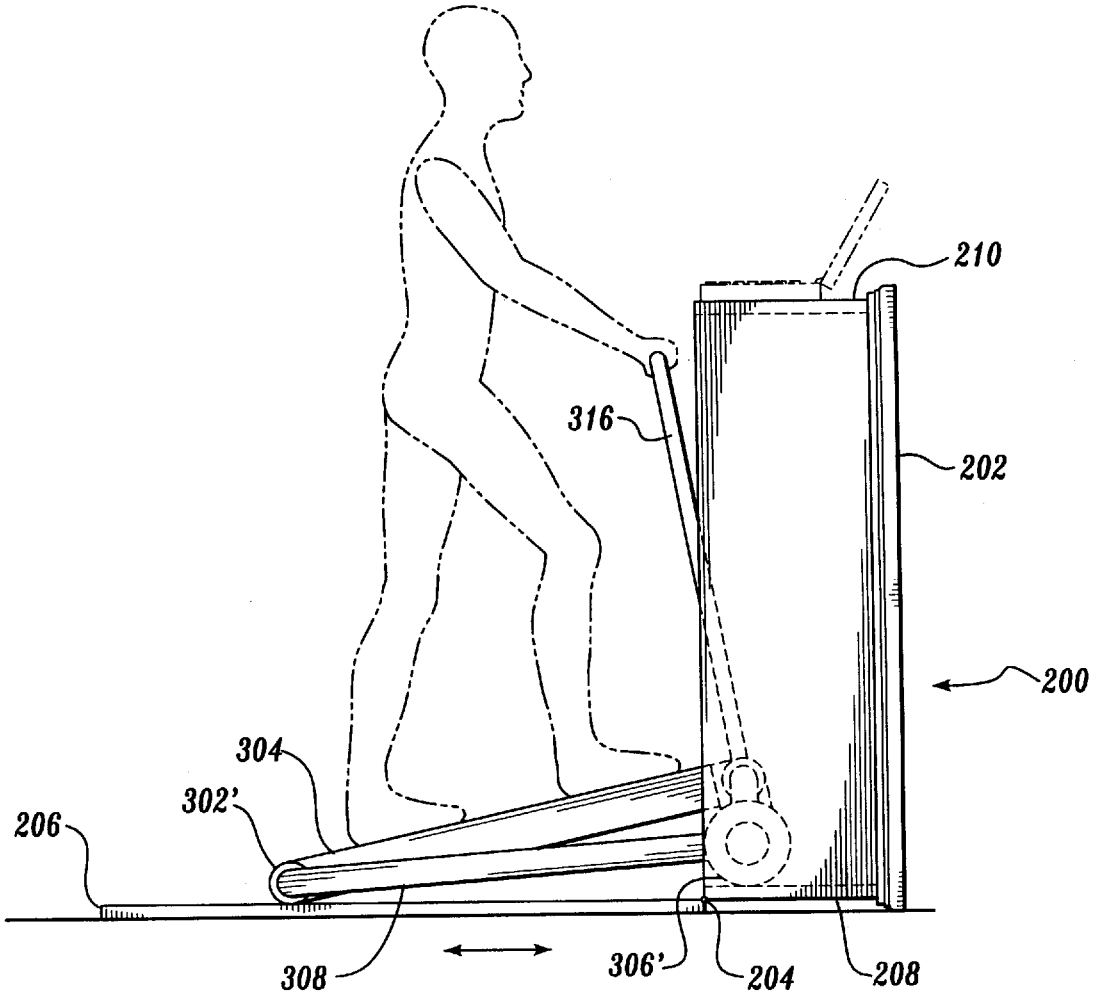
FIG. 12 is a side view of the third embodiment of the exercise desk in the open position, with the user exercising on the treadmill while using the work surface of the desk.

In FIG. 12, exercise desk 200 is shown in the open position, in which it serves as an upright desk for use while exercising on treadmill 300'. To achieve the configuration shown in FIG. 12, exercise desk 200 is pivoted about hinge 204, so that end 210 becomes a horizontal top surface and is disposed above bottom 206, which rests on the floor. In this embodiment, a "U-shaped" handle 316 is optionally provided on treadmill 300' to provide support for the user while exercising. However, the handle may be omitted, and the user can simply grasp end 210 to secure any required support when using the exercise equipment, such as the treadmill. It should be noted that when exercise desk 200 is in its open position, treadmill 300' can be rolled into the interior of the exercise desk on wheels 306' to shift the user closer to the work surface comprising the top of end 210. Wheels 306' readily roll from bottom 206 onto the inner surface of end 208 to advance the user closer to the work surface on the outer surface of end 210.

Figure 13:
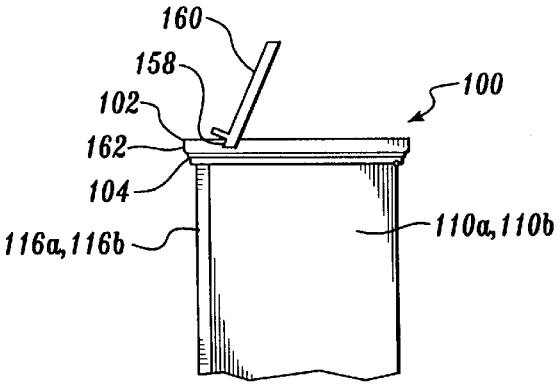
FIG. 13 is a side view of the first embodiment of the exercise desk, illustrating an angled support for reading material disposed on the working surface of the desk.
Figure 14:
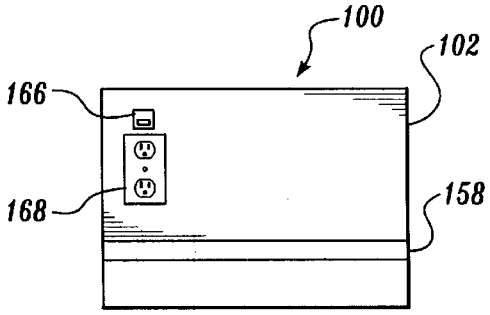
FIG. 14 is a top view of the first embodiment of the exercise desk displaying a slot for engaging the holder, an electrical outlet, and a data outlet.

In FIGS. 13 and 14, a modification of exercise desk 100 is illustrated in which a book stand 160 is supported within a diagonally beveled channel 158 formed adjacent the edge of top 102 (above desk doors 116*a* and 116*b*) and extending across its width. Book stand 160 is easily lifted out of the channel 158 and stored inside exercise desk 100 when not needed.

As shown in FIG. 14, an electrical outlet 168 and a RJ-11 data or telephone terminal 166 are optionally mounted in top 102. The electrical outlets and terminal can be used to respectively supply electrical current and data/communications to various electrical/electronic devices (such as a computer, fax, or telephone) employed by the user while exercising.

Figure 15:
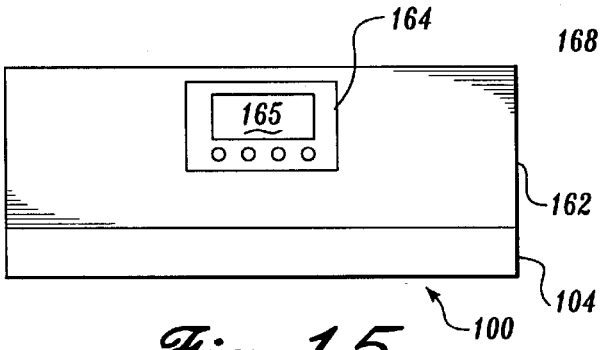
FIG. 15 is a top view of the third embodiment of the exercise desk's working surface that includes an electronic instrument for measuring exercise activity.

In FIG. 15, a front view of the upper section of a further alternative embodiment of desk 100 is illustrated. An electronic device 164, that includes a display screen 165 employed to display parameters related to a user's exercise, is shown mounted to a front panel 162. Panel 162 is disposed near the top of front side 112 (shown in FIGS. 1, 2, and 4–6). The parameters appearing on the display are derived from sensors (not shown) that couple to the exercise device and/or to the user's body, and may include the rate of exercise, calories consumed, relative distance traveled, heart rate, cadence, etc.

Figure 16:
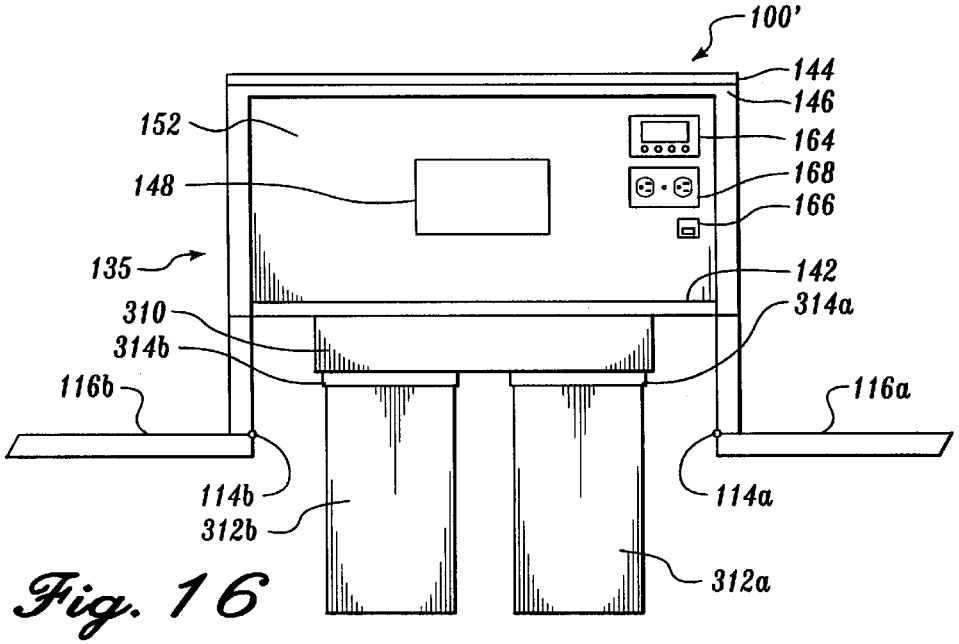
FIG. 16 is a top view of the second embodiment of the exercise desk, showing a work surface that includes an electronic instrument for measuring exercise activity, a data outlet, and an electrical outlet.

In FIG. 16, an optional modification of exercise desk 100' is illustrated. In this view, top 135 is open, exposing bottom surface 152. Electrical outlets 168, data or telephone terminal 166, and electronic device 164 are shown mounted on bottom surface 152, so that a user can enjoy the use of electronic/electrical devices while exercising. In FIG. 17, a modification of exercise desk 200 is displayed. Electrical outlets 168, data or telephone terminal 166, and electronic device 164 are shown mounted on end 210. In this configuration, a user can employ various electronic/electrical devices during exercise. However, when the exercise device is not in use and exercise desk 200 is being used a low table or bench, these components are visible on end 210, which may be undesirable.

Figure 18A:
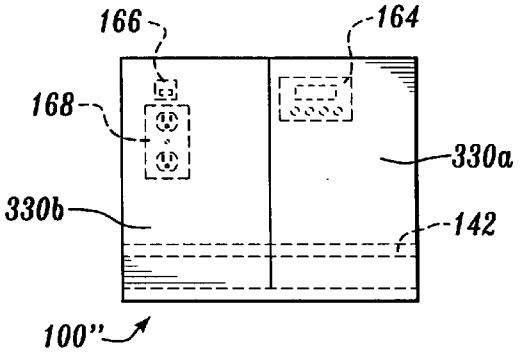
Figure 18B:
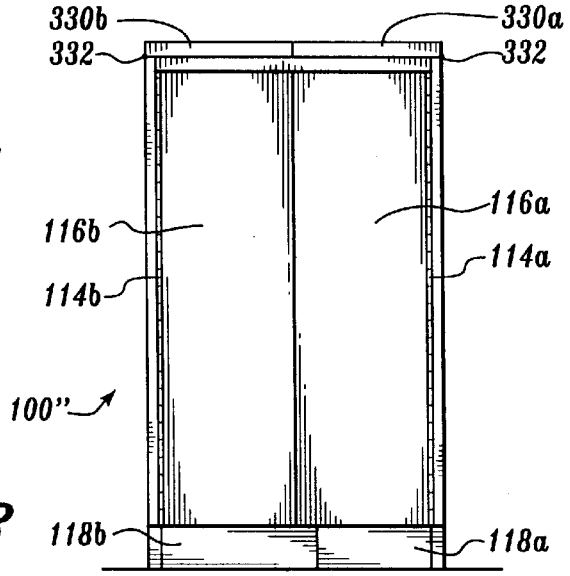
Figure 18C:
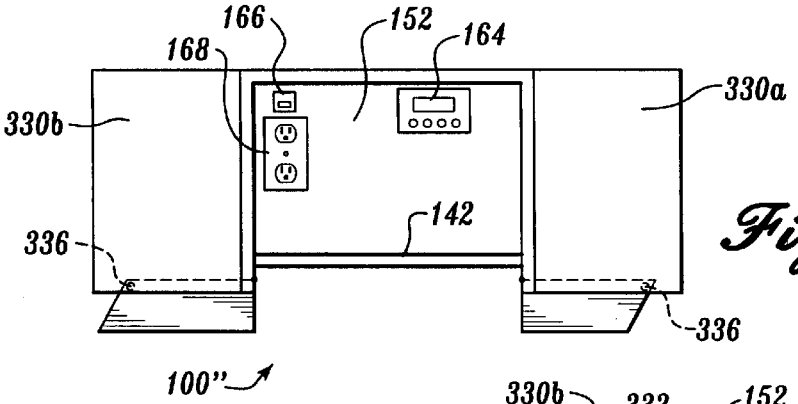
Figure 18D:
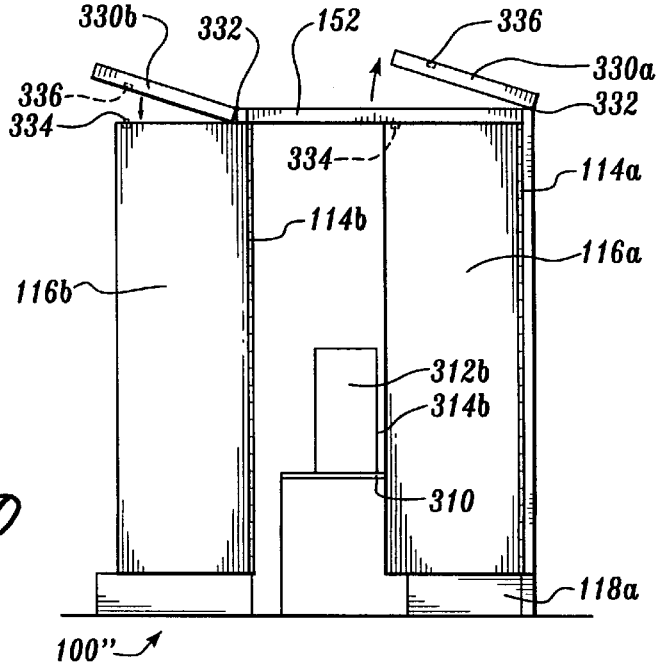

With reference to FIGS. 18A through 18D, an exercise desk 100" is illustrated that includes a right top panel 330*a* and a left top panel 330*b* that are pivotally attached along the top of opposite sides of the exercise desk, using hinges 332. When closed, the top panels provide a smooth upper surface, which can serve as a working surface for a stand-up desk, or if the exercise desk is turned over on its doors, can comprise one end of the exercise desk when it serves as a bench or low table. When closed, as shown in FIG. 18A, the top panels cover bottom surface 152, which includes electrical outlets 168, data or telephone terminal 166, and electronic device 164, as described above. As shown in FIG. 18D, the top panels are swung upward and to each side, exposing bottom surface 152 and providing additional work space on each side of the bottom surface when the user is exercising on stair-step machine 310. Doors 116*a* and 116*b* support top panels 330*a* and 330*b*, respectively when both the doors and top panels are fully open. To help maintain the doors under the top panels, a nib or pin 334 that is disposed on the top edge of each door engages a corresponding orifice 336 that is disposed near the corner on the bottom surface of each top panel (when open), as shown in FIG. 18D.

In addition to the treadmill and stair-stepping machine exercise devices discussed above, there are other devices that may be used with the various embodiments of the present invention, such as stationary bicycles, and stationary cross-country ski machines. Virtually any exercise device on which the user remains standing or sitting can be combined with a decorative furniture-like cabinet to enable a user to exercise while employing a working surface on the exercise desk to support other articles required for working or other activities unrelated to exercising. Further, the exercise devices can be mounted on wheels or skids, so that they may be conveniently deployed at various distances from the working surface of the exercise desk when in the open position.

Other modifications of the exercise desk are also contemplated within the scope of the claims that follow. For example, the working surface of the exercise desk can have depressions or cavities formed therein shaped to securely hold or position items used during exercise. Such items might include beverage containers, reading materials, and electronic equipment, i.e., radios, computers, fax machines, telephones, remote controls, and televisions.

All of the embodiments of the exercise desk are preferably constructed using materials for the enclosure having a look and finish that is more commonly associated with materials of the sort used in constructing fine furniture. Thus, the exercise desk can be constructed of wood, wood substitutes, composite materials, metal, and plastics. The intention is to provide an exercise desk that has moldings, texture, color, and the look and feel of furniture. Because the exercise equipment stored inside the exercise desk is readily deployed and permits the user to both exercise and carry on other activities, such as work-related activities, the present invention enables a user to optimize the time spent exercising, reap the benefits of exercise, and avoid the visual clutter and appearance of exposed exercise devices.

Although the present invention has been described in connection with the preferred form of practicing it, those of ordinary skill in the art will understand that many modifications can be made thereto within the scope of the claims that follow. Accordingly, it is not intended that the scope of the invention in any way be limited by the above description, but instead be determined entirely by reference to the claims that follow.

The invention in which an exclusive right is claimed is defined by the following:

1. An exercise desk that enables a person to exercise while carrying on another activity unrelated to exercising, comprising:

(a) an exercise device having a front and at least one force resisting movable part coupled thereto, said at least one movable part being adapted to receive force applied by the person when exercising in an upright position, said exercise device being selectively configured in a first state in which the exercise device is unusable for exercising and a second state in which the exercise device is usable for exercising;

(b) an enclosure having an opening on at least one side for receiving and storing said exercise device when the exercise device is in the first state, said enclosure being disposed adjacent to the exercise device when the exercise device is in the second state in which it is usable for exercising; and (c) a work surface comprising one side of the enclosure, said work surface being oriented so as to define an upper surface of the enclosure when the exercise device is in the second state, said enclosure disposed at the front of the exercise device being sized so that the upper surface is at a height that enables said upper surface to be adapted to support an article for use by the person when engaged in the other activity while exercising in the upright position and said upper surface thereby serving as the work surface.

2. The exercise desk of claim 1, wherein the exercise device is pivotally attached to the enclosure about a pivot axis and is movable between the first state and the second state about the pivot axis.

3. The exercise desk of claim 1, wherein the exercise device comprises one of a treadmill, a stair-step machine, a cross-country ski machine, and a stationary bicycle.

4. The exercise desk of claim 1, wherein the enclosure includes a moveable cover that is positionable over said at least one side of the enclosure to at least partially close said one side of the enclosure when the exercise device is stored in the first state.

5. The exercise desk of claim 1, wherein the enclosure has a generally rectilinear, elongate shape.

6. The exercise desk of claim 1, wherein the work surface is pivotally attached to the enclosure about a pivot axis and is movable about the pivot axis to enable the exercise device to be moved between the first and the second states.

7. The exercise desk of claim 1, wherein the enclosure is adapted to be tilted from an upright position, said enclosure remaining in the upright position while the exercise device is in the second state, to a horizontal position wherein the enclosure substantially covers and encloses the exercise device in the first state, said enclosure serving as a table when in the horizontal position.

8. The exercise desk of claim 1, wherein the work surface has a channel formed in said surface that engages a holder, said holder being adapted to support written materials at an angle, so that said written materials may be viewed by the person while exercising.

9. The exercise desk of claim 1, wherein the work surface has a data outlet for supplying data to an electronic device.

10. The exercise desk of claim 1, wherein the work surface has an electrical outlet for supplying electricity to an electrically powered device.

11. The exercise desk of claim 1, wherein the work surface has an electronic device for determining exercise data.

12. The exercise desk of claim 1, further including panels pivotally attached to each side of the exercise desk, said panels being closed over a portion of the work surface when the exercise device is in the first state and opened to each side of said portion of the work surface when the exercise device is in the second state, said panels providing a work surface having an area greater than that of an end of the exercise desk.

13. An exercise desk that enables a person to exercise in an upright sitting or standing position while carrying on another activity unrelated to exercising, comprising:

(a) an exercise device having a force resisting surface, said force resisting surface being adapted to receive force applied by the person while exercising, said force causing movement of an element coupled to the exercise device; and (b) an enclosure useable as:

(i) a desk while the person is exercising on the exercise device in the upright position, said enclosure having a work surface with a receptacle that is adapted to support an article for use by the person when engaged in the other activity while thus exercising;

(ii) an enclosure for the exercise device when it is not being used for exercising, said enclosure having an interior in which the exercise device is then disposed and having a furniture-like exterior; and (iii) a support that is selectively accessible by the person while exercising to provide stability.

14. The exercise desk of claim 13, wherein the exercise device is pivotally connected to the interior of the enclosure, enabling one of the exercise device and the enclosure to be pivotally tilted relative to the other to enclose the exercise device within the interior of the enclosure.

15. The exercise desk of claim 13, wherein the enclosure is tilted over to substantially enclose and cover the exercise device within the interior of the enclosure when the exercise device in not in use, said enclosure then serving as a table.

16. The exercise desk of claim 13, wherein the receptacle in the work surface comprises a slot for holding an upright plate to support a book-like object.

17. The exercise desk of claim 13, wherein the receptacle in the work surface comprises a recess sized to hold at least one of a telephone, a writing implement, an electronic remote control, and a portable computer.

18. The exercise desk of claim 13, wherein the enclosure includes an electrical lead that is adapted to connect to the article.

19. The exercise desk of claim 13, wherein the enclosure includes at least one door that is closed when the exercise device is stored within the interior of the enclosure to at least partially conceal the exercise device.

20. The exercise desk of claim 13, further comprising a cover for closing the enclosure while the exercise device is stored within the interior of the enclosure, said cover at least partially concealing the exercise device within the interior of the enclosure.

21. The exercise desk of claim 20, further comprising a lock that secures the cover in place while the lock is engaged, said lock preventing access to and use of the exercise device stored within the interior of the enclosure.

22. The exercise desk of claim 20, wherein the work surface is pivotally attached to the enclosure about a pivot axis, said work surface being pivoted about the pivot axis to provide clearance while moving the exercise device into and out of the interior of the enclosure.

23. The exercise desk of claim 22, wherein the work surface includes a lip that prevents the cover from being opened away from the enclosure and thus keeps the exercise device from being moved out of the interior of the enclosure until the work surface is pivoted upwardly to enable the lip to clear the cover.

24. The exercise desk of claim 13, further comprising an indicator mounted on the enclosure, said indicator being coupled to the exercise device to provide an indication of a parameter related to exercising with the exercise device.

25. The exercise desk of claim 13, wherein the exercise device comprises one of a treadmill, a stair-step machine, a cross-country ski machine, and a stationary bicycle.

26. The exercise desk of claim 13, wherein the enclosure has a generally rectilinear, elongate shape.

27. The exercise desk of claim 13, wherein the enclosure includes a decorative molding so that when being used to store the exercise device, the enclosure appears to be a piece of furniture and the exercise device is not visible within the interior of the enclosure.

28. The exercise desk of claim 13, wherein the exercise device is configurable to a smaller size for storage, compared to its size when being used, said smaller size enabling the exercise device to be stored within the interior of the enclosure.

29. The exercise desk of claim 13, wherein the work surface has a channel formed in said surface that engages a holder, said holder being adapted to support written materials at an angle for viewing by the user while exercising.

30. The exercise desk of claim 13, wherein the work surface has a data outlet for supplying data to an electronic device.

31. The exercise desk of claim 13, wherein the work surface has an electrical outlet for supplying electricity to an electrically powered device.

32. The exercise desk of claim 13, wherein the work surface has an electronic device for determining exercise data.

33. The exercise desk of claim 13, further comprising a panel that is pivotally attached to the enclosure and pivotal between a first position in which at least a portion of the work surface is covered by the panel and a second position in which an under surface of the panel comprises a portion of the work surface.

34. An exercise desk that enables a person to exercise while carrying on another activity unrelated to exercising, comprising:

(a) an exercise device having at least one force resisting movable part coupled thereto, said at least one movable part being adapted to receive force applied by the user when exercising in an upright position, said exercise device being selectively configured in a first state in which the exercise device is unusable for exercising and a second state in which the exercise device is usable for exercising;

(b) an enclosure having an opening on at least one side for receiving and storing said exercise device when the exercise device is in the first state, said enclosure being disposed adjacent to the exercise device when the exercise device is in the second state in which it is usable for exercising; and (c) a work surface comprising one side of the enclosure, said work surface being pivotally attached to the enclosure about a pivot axis and movable about the pivot axis to enable the exercise device to be moved between the first and the second states, said work surface being oriented so as to define an upper surface of the enclosure when the exercise device is in the second state, said enclosure being sized so that the upper surface is at a height that enables said upper surface to support an article for use by the person when engaged in the other activity while exercising in the upright position, and said upper surface thereby serving as the work surface.

35. An exercise desk that enables a person to exercise while carrying on another activity unrelated to exercising, comprising:

(a) an exercise device having at least one force resisting movable part coupled thereto, said at least one movable part being adapted to receive force applied by the user when exercising in an upright position, said exercise device being selectively configured in a first state in which the exercise device is unusable for exercising and a second state in which the exercise device is usable for exercising;

(b) an enclosure having an opening on at least one side for receiving and storing said exercise device when the exercise device is in the first state, said enclosure being disposed adjacent to the exercise device when the exercise device is in the second state in which it is usable for exercising; and (c) a work surface comprising one side of the enclosure, said work surface being oriented so as to define an upper surface of the enclosure when the exercise device is in the second state, said enclosure being sized so that the upper surface is at a height that adapts said upper surface to support written materials for viewing by the person, said upper surface having a channel formed in said surface that engages a holder, said holder being adapted to support said written materials at an angle for viewing by the person when engaged in the other activity and while exercising in the upright position, so that said upper surface thereby serves as the work surface.

* * * * *